United States Patent [19]

Sélince

[11] Patent Number: 4,465,249

[45] Date of Patent: Aug. 14, 1984

[54] LATERAL ACCELERATION CONTROL METHOD FOR MISSILE AND CORRESPONDING WEAPON SYSTEMS

[75] Inventor: Gérard Sélince, Massy, France

[73] Assignee: Societe Nationale Industrielle Aerospatiale, Paris, France

[21] Appl. No.: 362,423

[22] Filed: Mar. 26, 1982

[30] Foreign Application Priority Data

Apr. 1, 1981 [FR] France ..... 81 06541

[51] Int. Cl.[3] ..... F41G 7/22

[52] U.S. Cl. ..... 244/3.15

[58] Field of Search ..... 244/3.15, 3.2, 3.21, 244/3.22

[56] References Cited

U.S. PATENT DOCUMENTS

| | | | |
|---|---|---|---|
| 3,072,365 | 1/1963 | Linscott et al. | 244/3.19 |
| 3,695,555 | 10/1972 | Chadwick | 244/3.14 |
| 3,735,944 | 5/1973 | Bannett et al. | 244/3.15 |
| 4,198,015 | 4/1980 | Yates et al. | 244/3.15 |
| 4,277,038 | 7/1981 | Yates et al. | 244/3.15 |

FOREIGN PATENT DOCUMENTS

| | | |
|---|---|---|
| 2226066 | 11/1974 | France . |
| 2230958 | 12/1974 | France . |

*Primary Examiner*—Charles T. Jordan

*Attorney, Agent, or Firm*—Karl W. Flocks; Sheridan Neimark; A. Fred Starobin

[57] ABSTRACT

A lateral acceleration control method for a missile permits short response times to commands even of great amplitude. It comprises the association of an aerodynamic control system having large lateral acceleration capability, called PAF, with a force control system close to the center of gravity, having a moderate lateral acceleration capability, but with very short response time, called PIF. The overall response to a command includes the usual response of the aerodynamic automatic pilot to which there is added the response from the force control system, such that in the presence of a constant order, after a delay equal to the response time of the PAF, the PIF is entirely available for a new action.

3 Claims, 5 Drawing Figures

V
IV
III
II
I
1
2
1 + 2
11A
11B
11
12
13

LATERAL ACCELERATION CONTROL METHOD FOR MISSILE AND CORRESPONDING WEAPON SYSTEMS

This invention relates to guided missiles for attrition of air attackers, more especially, those propelled at a very high speed on the trajectory, and having large maneuvering capability, with a final attacking approach being possible either in skimming flight or into a steep dive.

Generally, a target is more particularly characterized by its motion, i.e. speed, direction, maneuverability, trajectory. The target can be hit by a missile guided according to a guidance law (command to line of sight, proportional navigation), which brings the missile all the closer to the target as the latter moves in a slow and regular manner. In the case of an aerial target, the closer the explosion is to the objective, the smaller the warhead can be, for a given probability of destruction of said objective.

Any error at the end of the flight must be compensated for by a final maneuver of missile piloting to the target.

Thus, the higher the maneuverability and evasion performances of the target, the higher the lateral acceleration, particularly within the interception area, and the shorter the response times, should be.

In the design of new weapons, a typical offencing target, representing a threat particularly difficult to destroy consists of a extremely maneuverable supersonic missile performing the final approach in skimming flight or going into a steep dive. In this case indeed, the belated discovery of the hostile missile requires the earliest possible neutralization to assure security of the site to be protected.

For the time being, assault from such aggressors is difficult to oppose by means of the known defensive systems. A defensive missile with a conventional aerodynamic control guided on proportional navigation cannot intercept such aggressors unless it is equipped with a very extensive warhead.

One can certainly utilize a highly performing guidance law, such as that applied to known arms systems, but efficiency thereof depends on the knowledge of the time remaining before interception of the objective, and this, in a jamming environment, cannot be evaluated with the accuracy required for the intended purpose. This type of law, moreover, in a schematical manner, calls for a second order extrapolation of the motion of the objective, and due to this, it is defective if the target effects quick variations of motion of a random period having an average value equal to a few time constants of the defensive guided missile. The miss-distance obtained may then be higher than that resulting from a simple proportional navigation law, therby leading to again selecting a warhead of great mass.

Therefore, it is advisable to compensate for insufficiency of the guidance according to the above criteria, by increasing maneuverability of the defensive missile, i.e. increasing the load factor, and above all, reducing the response time of said defensive missile.

In a missile of standard aerodynamic control achieved by angle of attack pickup, the time constant related to the aerodynamic response is always great, in the order of several tenths of second. This type of control is called hereinafter PAF.

The control devices provoking such angle of attack pickup are either of the aerodynamic type or controls in the jet of the main propulsive device, or else, through lateral auxiliary jets from the main propulsive device or independent elements.

Furthermore, a response time of only a few hundreths of second can be obtained by utilization of forces substantially passing through the center of gravity, and such forces can be acquired aerodynamically, or by lateral jets. In this case, there is little or no aerodynamic angle of attack pickup, but rather direct displacement of the center of gravity.

Such a known mode of control called force control and designated hereinafter as PIF essentially supplies very high quickness of response.

This invention essentially consists of the association of the aerodynamic control PAF bringing especially a high lateral acceleration, with the PIF control, which procures a great quickness of response, on the one hand, and on the other hand, enables significant enhancing of overall maneuverability of the missile.

This invention, in combination with numerous known devices, permits to devise various systems of new weapons capable in particular to assure destruction of a supersonic aircraft of very high maneuverability effecting the approach in skimming flight or going into very great angle of dive.

A first weapons system according to the invention consists of ejecting vertically a missile, with its booster being extinct, tipping it over in the direction of the target by using the PIF control method, igniting the booster to bring the missile to a very high speed, and then, upon completed combustion of said booster, and with the center of gravity of the missile remaining now stationary, permitting the use of the PIF-PAF control.

A second weapons system consists of dropping the missile from an aircraft, and using its own devices to effect quick motion in the direction of the objective.

The invention will be better understood hereinafter in the light of the following description of the exemplifying, not limitative, weapons system called SAN (ground, air, naval) for self-defense of the surface vessels, with the help of the attached drawing in which.

Figure 1:
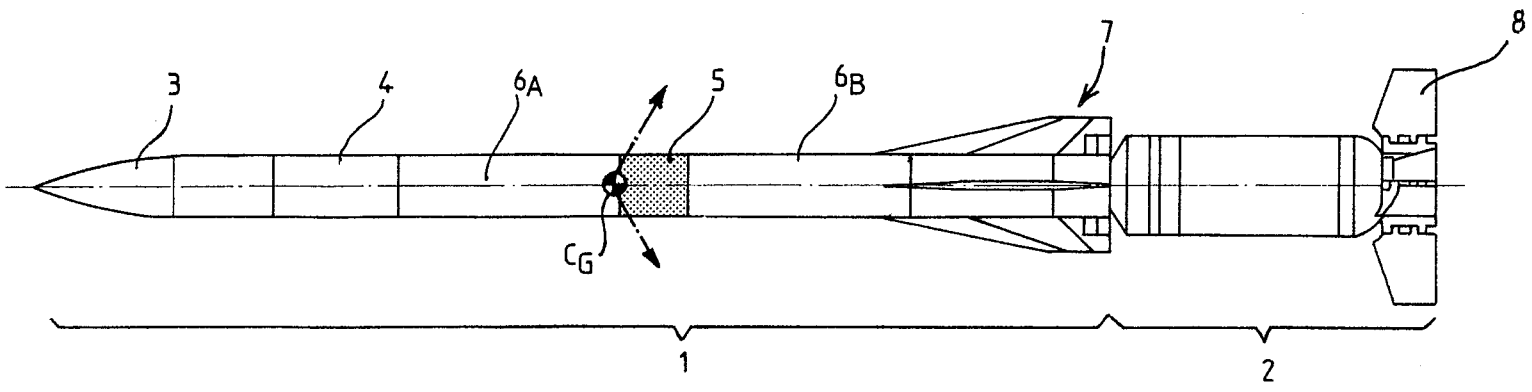
FIG. 1 is a schematic view of the missile showing its aerodynamic PAF, control means, its PIF force control means and its booster which in the present case, is jettisonable

In accordance with the invention, the missile of FIG. 1 comprises in the usual way an automatic three-axes pilot. Detection of the target is effected on the site (for example, a watch radar 11A on a surface vessel 11 which supplies the situation of the target in site, bearing and range), and the processed elements are transmitted to said missile.

It turns out that, in the case of very swift targets of supersonic speed effecting approach in skimming flight, belated direction there of requires sooner destruction to assure the security of the protected site.

At the missile, this implies a high average speed on the trajectory, a great capability of maneuvering, a small miss distance associated with such a warhead able of ensuring destruction of the objective.

Unfortunately, it is known that the present missiles guided by proportional navigation do not meet these criteria except when they are equipped with a very large military charge. As a matter of fact, they are defective, due to the high capability of maneuvering of the target and its short response time.

To remedy such difficulties, it is proposed according to the invention, to associate with a missile comprising aerodynamic control means, with a high load factor, called PAF, a force control mode called PIF, such control mode comprising means producing forces passing close to the center of gravity, as suggested by the representation of FIG. 1.

It is to be noted that the latter means can be different types and result either from aerodynamic action through controls or from jets.

Thus, in the schematic view of FIG. 1, references 1 and 2 designate the missile and its jettisonable booster respectively. The missile 1 comprises a homing-head 3, control and guidance equipments 4, a force control mode PIF, comprising in its turn a jet deflector device 5 producing forces passing close to the center of gravity $C_G$ and propulsive means $6_A$ and $6_B$ arranged near by the deflector device 5 such that the known movement of the center of gravity $C_G$ remains very small as the propellant burns out, a wing and PAF aerodynamic control means assembly designated by the general reference 7. Reference 8 designates the stabilizer, in this case displayable, of the jettisonable type booster 2.

This new lateral acceleration control method for a missile permits to procure very short response time to any commands even of great amplitude; it results therefore from the association of an aerodynamic control system having a high lateral acceleration capability with a force control system passing close to the center of gravity with a moderate lateral acceleration capability but a very short response time.

Such association is characterized by the following equation:

$$\Gamma ex = \left\{ \frac{G(p) \cdot Og}{\Gamma 1} + \frac{[F(p) \cdot (1 - G(p)]\, Og}{\Gamma 2} \right\}$$

in which:

0g = the guidance command,

F(p) = the PIF transfer function,

G(p) = the PAF transfer function,

Γex = the total acceleration executed by the missile,

Γ1 = the PIF acceleration,

Γ2 = the PAF acceleration;

and which is put into practice by application of this equation.

Figure 4:
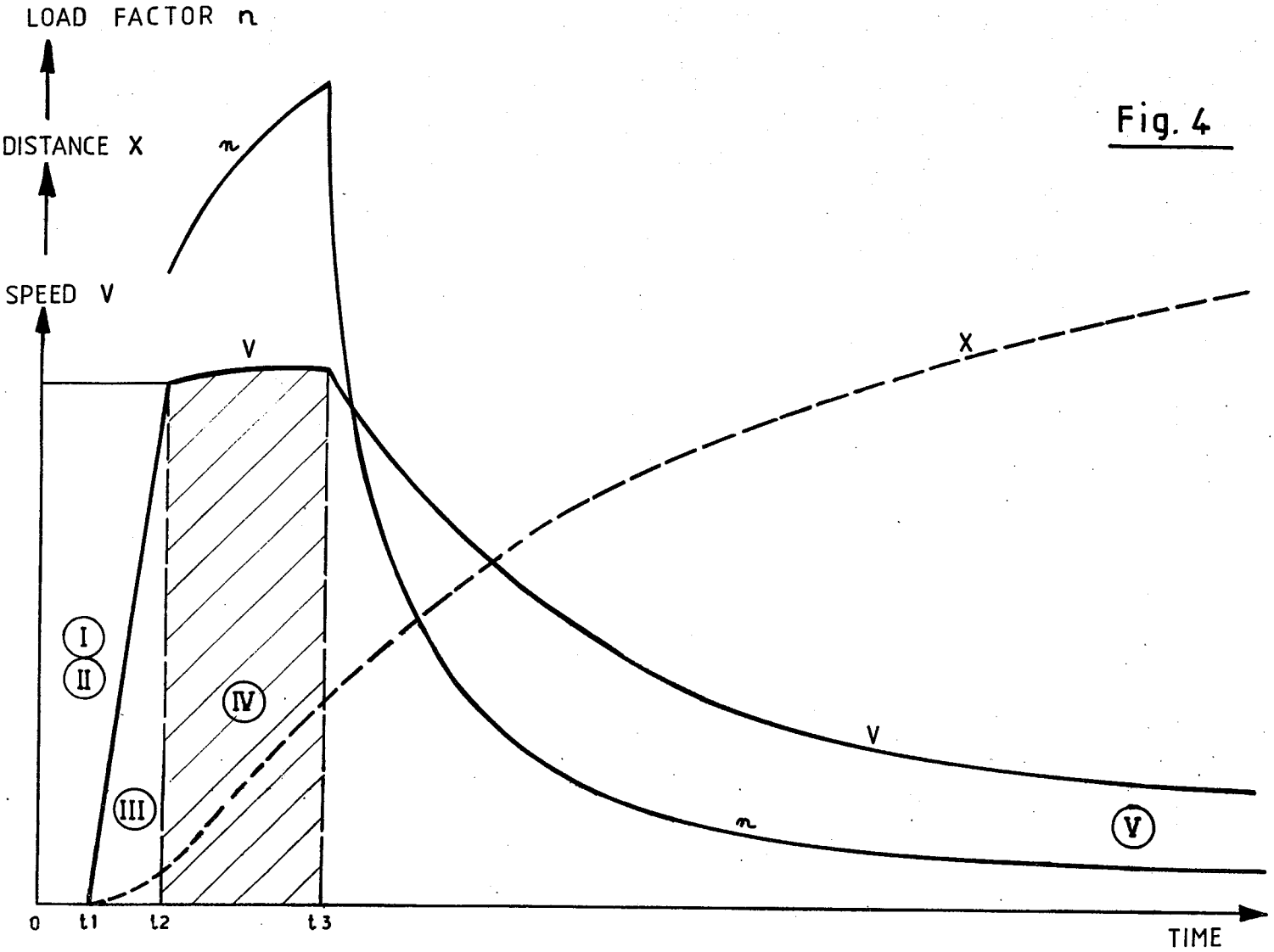
FIG. 4 shows curves representing performances of the SAN missile during interception of a target.

FIG. 4 schematically represents the development of the main characteristics, i.e. speed V, lateral acceleration capacity n and distance travelled X, as a function of the sequential progress of the flight of the missile, according to its various modes of operation, divided into phases I, II, III, IV and V, respectively defined as follows:

0−t1: vertical launching of composite 1+2, at low speed (phase I), tipping over of the composite (phase II), t1−t2:phase III:acceleration by igniting the accelerator 2, t2−t3:phase IV:missile 1 controlled in PIF-PAF, the center of gravity practically stationary, t3→:phase V:missile 1 controlled in PAF alone.

It appears now clearly in FIG. 4 that it is essentially during phase IV (t2−t3) that missile 1 possesses all the performing means to destroy, in addition to the conventional objectives, those objectives which have the best known performances, i.e. possibility of attacking in skimming flight or steep dive, high maneuverability or else random evasiveness, therefore, those objectives susceptible to the most belated detection.

It also appears from FIG. 4 that due to the PAF control, the missile 1 remains capable during phase V, beyond t3, of attacking more remote conventional targets.

Figure 2:
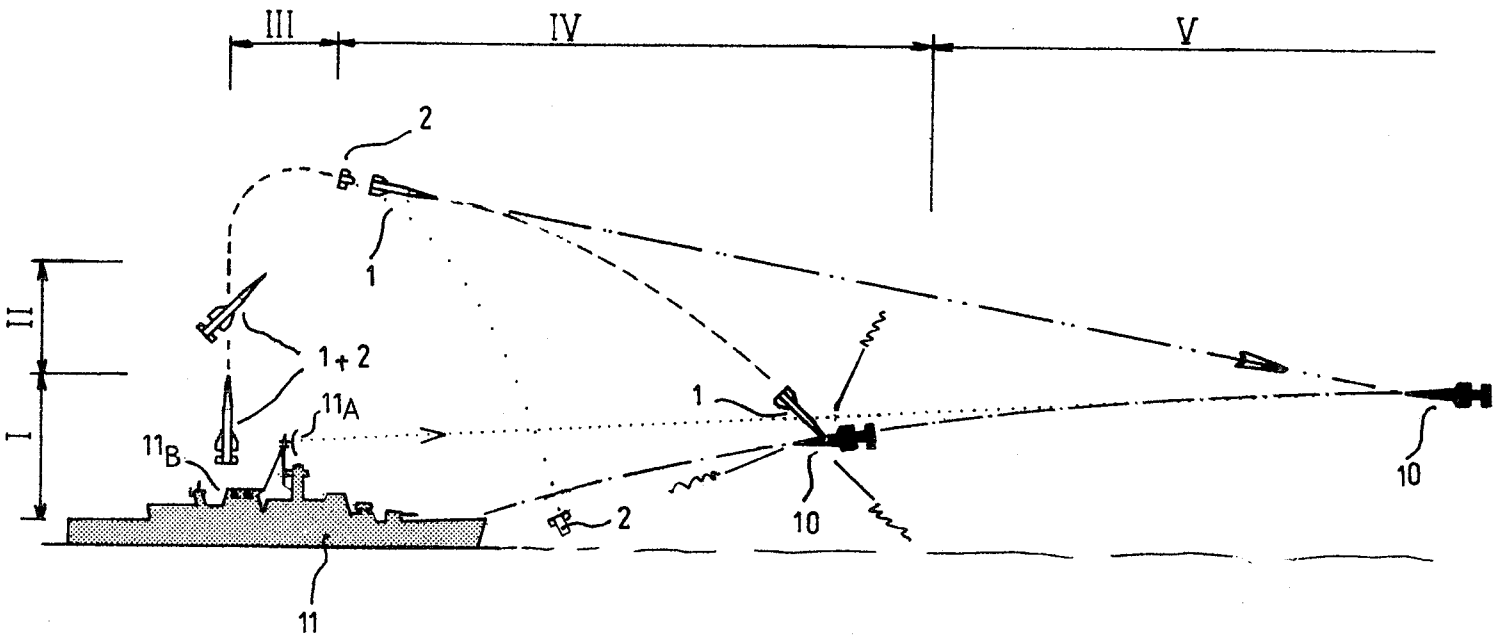
FIG. 2 is a schematic view showing development of the interception, by the weapons system SAN, of a quick target having very high maneuverability.
Figure 3:
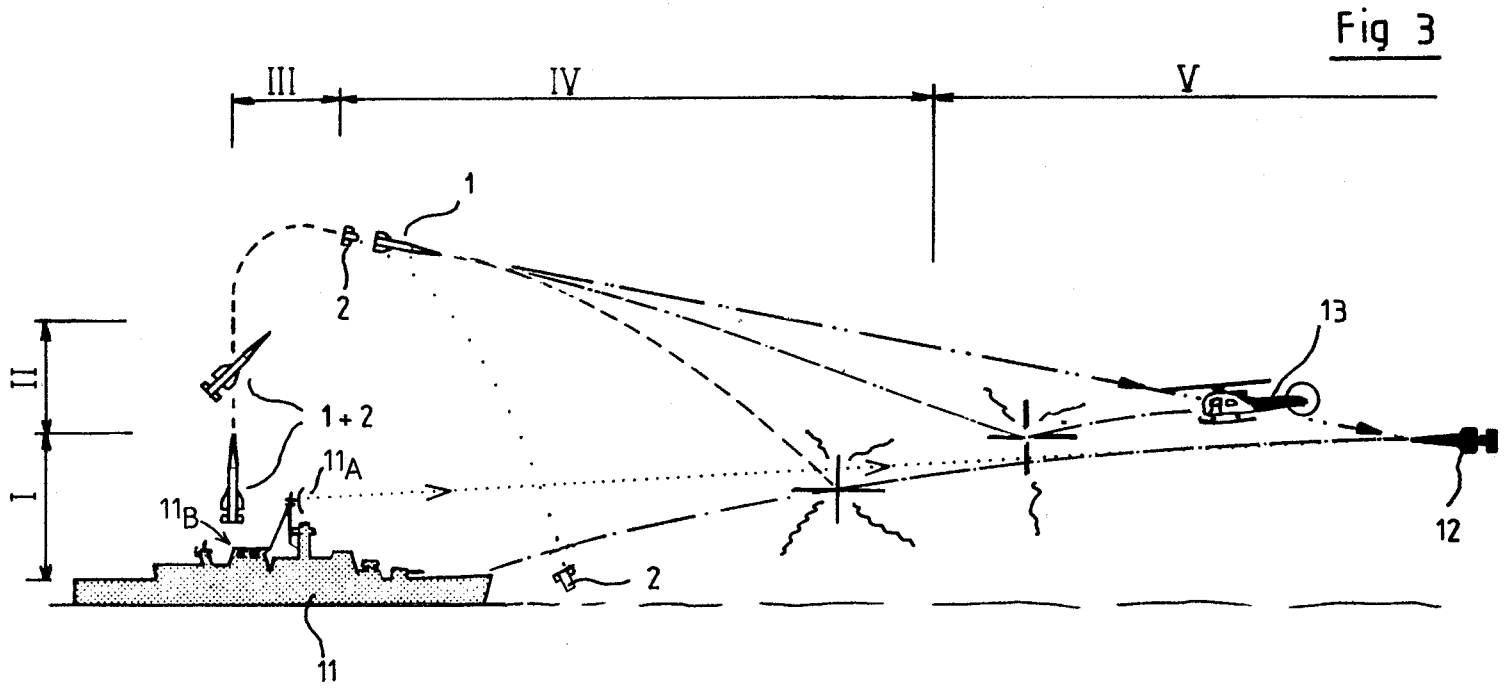
FIG. 3 is a schematic view showing interception of conventional targets.

This is illustrated in FIGS. 2 and 3, in which can be respectively seen an objective 10, of high performances attacked during phase IV (FIG. 2) or less performing, but more remote, objectives such as helicopters 13 or airplanes 12 attacked during phase V (FIG. 3).

It is obvious that objectives 12 or 13 could all the more be destroyed during phase IV.

According to a first form of embodiment of the invention (FIG. 2), in an weapon system comprising a vertical launching and a tipping over in a phase I, the composite 1+2, with the missile and booster assembly being extinct, is ejected from a site 11 at a speed in the order of a few tens of meters per second, for example, by means of a gas generator associated with the launching tube 11B.

Several tenths of second after such vertical launching (phase I), the first PIF force control stage is initiated thereby enabling to realize in phase II the tipping over of said assembly in a few tenths of second.

In phase III, the booster is ignited to provoke acceleration of the missile up to about 1000 m/s.

At the end of the combustion of the booster, the center of gravity remains practically fixed; the booster is jettisoned in the present case.

During those phases II and III, the homing-head starts its search for the target 10 and in case of locking on before the end of the acceleration phase III, a first correction of orientation of the missile is realized then, by means of the PIF.

Finally, in phase IV, the missile 1 which has then a slightly accelerated high speed and is controlled by the PIF-PAF autopilot, effects:

if the homing-head has not yet engaged, a mid-course phase updated from the launching site such as surface vessel 11, if the homing-head is engaged, its proportional navigation in the direction of the target 10.

In the case of a target 10 at very low altitude, the trajectory in a vertical plane is effected with a slight angle of dive to prevent certain possible effects such as for example the imaging effect on the sea.

The control of the missile is ensured in the following way:

After the few tenths of second of free flight following the vertical ejection, the missile is controlled by the automatic pilot which has three modes of operation.

According to the first mode, which takes care of the control of the composite 1+2 during the tipping and acceleration phases, the yaw and pitching control is provided by the first level of functioning of the PIF, i.e., with the action of said PIF device, offset relative to the center of gravity.

In the second mode, which is the cruising control, the automatic yaw and pitching pilot is a lateral acceleration servo-control of high dynamic performances. It comprises a conventional aerodynamic pilot of the PAF type, having a time constant in the order of several tenths of second associated according to the invention with a force control of the PIF type, with the center of gravity being this time practically stationary, and the response time of which is then very short, in the order of one hundredth of second.

Thus, according to the invention, there are obtained the following:

high maneuverability in the order of 50 g, this being the addition of the high maneuvering capability from the PAF and of that of the PIF force control, associated with a very short response time, in the order of one hundredth of second, and this being all throughout the range of use, a response time close to that of the PIF for the typical commands that may solicit the automatic pilot.

By defining a preferred type of association, it is possible to mention hereinbelow a concept well adapted to the self-guiding problem.

If one designates:

Og=the guiding command (m/s2),

F (p)=the PIF transfer function,

Γ1=the acceleration realized by the PIF,

G(p)=the PAF transfer function,

Γ2=the acceleration realized by the PAF,

Γex=total acceleration realized by the missile, the transfer function, in the linear domain, can then be written:

$$\frac{\Gamma ex}{Og} = F(p) + G(p) - F(p) \cdot G(p)$$

and, then, admitting in an exemplifying manner, $$F(p) = \frac{1}{1 + 0.01p} \qquad G(p) = \frac{1}{1 + 0.1p}$$

a transfer function of the PIF-PAF pilot:

$$\frac{Fex}{Og} = \frac{1 + 0.11p}{1 + 0.11p + 0.001p2}$$

Thus, it can be demonstrated that the response time of the pilot is slightly lower than that of its components, while remaining however close enough to that of the quickest.

In other terms, it can be seen that physically the PIF functions as a vernier relative to the execution error of the PAF, and that in the presence of a constant command, and after a delay equal to the response time of the PAF, the PIF is entirely available for quickly executing a new action.

The third mode which corresponds to the free flight control, after stopping the PIF device, becomes a mode of the conventional type.

The PIF device can be reactivated later.

The guidance proper comprises a mid-course guidance and a terminal homing phase guiding.

The mid-course guidance is inertial, effected from information from the center, possibly updated in flight each second, and data from an inertial unit of for instance the strap down type.

It comprises two steps, a tipping step, during which a servo-control of attitude is realized, watched by the PIF device, and an acceleration step, during which the missile constantly watched by the PIF device is directed to an intermediary point between the present target and the future target.

The homing phase begins soon upon the release of the accelerator and this requires about 0.1 second. The guidance law is a purely proportional navigation having a coefficient of about 4, with correction of deceleration of the missile in the coasting flight phase.

Figure 5:
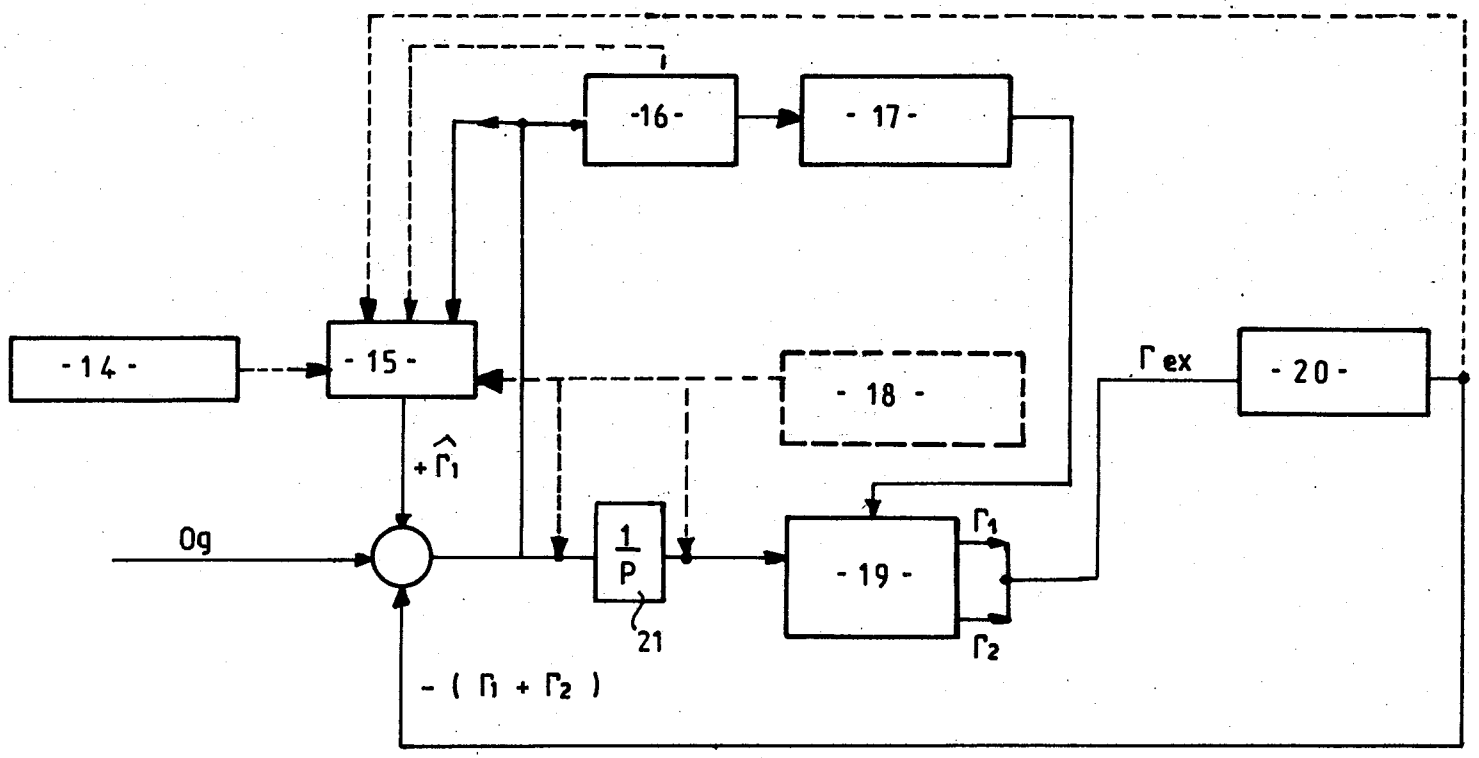
FIG. 5 is a block diagram showing in an exemplifying manner the realization of a PIF-PAF autopilot.

According to FIG. 5, the block diagram represents one possible control PIF-PAF device for a missile 19. It consists of:

a conventional lateral acceleration aerodynamic pilot called PAF, and comprising, for example, an accelerometer 20, a gyrometer 18 and an integration 1/p. 21 (p being LAPLACE's symbol), a force control device called PIF 17, with a low response time, such as a deflector of jets, impulsers . . . and its control device 16, a simulator 15 of the PIF behaviour that may receive information from 16, 18, 20 and the pressure sensor 14, if this is a PIF using a gas propulsive device or generator.

The guidance command augmented with the output from model 15 is applied to the input to the aerodynamic pilot. The servo-control error of the aerodynamic pilot is applied both to the input of the device 16 for controlling the PIF and to its function simulator 15.

In other terms, the PIF works as a vernier with respect to the error of the PAF thereby permitting to obtain a comprehensive device having a maneuvering capability which is the addition of the respective maneuvering capability of each of the partial devices therein, and the response time of which is close to the response time of the quickest partial device thereof.

It will be understood that the invention can be realized in a weapon system that must assure the autonomous protection of a surface vessel.

The invention could also be applied to any other weapon system comprising any launching platform, whether stationary, movable or half-movable.

The invention is not limited to the described form of embodiment but can also include any variations that might enter within its scope which is defined in the appended claims.

I claim:

1. A lateral acceleration control method with commands for a missile comprising an aerodynamic automatic pilot, providing a very low response time to commands, even of great amplitude, wherein said control method comprises the association of:

an aerodynamic control system having a great lateral acceleration capability, called PAF, with a force control system close to the center of gravity of said missile, and having a moderate lateral acceleration capability but a very short response time, called PIF;

said association being such that its overall response to a command is given by the following equation:

$$\Gamma ex = \left\{ \frac{G(p) \cdot Og}{\Gamma 1} + \frac{[F(p) \cdot (1 - G(p)] \, Og}{\Gamma 2} \right\}$$

in which:

Og = the guidance command,

F(p) = the PIF transfer function,

G(p) = the PAF transfer function,

Γex = total acceleration realized by the missile,

Γ1 = the PIF acceleration, and

Γ2 = the PAF acceleration;

and wherein there can be distinguished the usual response of the aerodynamic automatic pilot G(p)Og, to which there is added the PIF's response, F (1 − G)Og, working on the error, (1 − G(p))Og, of the PAF, in such a way that, in addition, and in the presence of a constant command and after a delay equal to the response time of the PAF, the PIF is entirely available for realizing a new action.

2. A device for application of the method as in claim 1, to a weapon system for destroying a target with a missile including a homing head and a booster, comprising:

vertical ejection means for launching the missile, means for bringing to normal operation the force control system PIF, thereby enabling the tipping over due to the offsetting position of the center of gravity before complete combustion of the booster, means for accelerating the missile, which during such phase, is controlled by the PIF device, means for tracking the target to produce in case of locking on, before the end of the acceleration phase, a first correction of orientation of the missile through the PIF, a PIF-PAF controlling means which effects:

an updated mid course phase if the homing head has not locked onto a target, a guidance in the direction of the target using the PIF-PAF control at least close to said target, and means permitting the use of the PAF, after using the PIF, if need be.

3. A control device for application of the method as in claim 1, wherein the aerodynamic control system PAF and force control system PIF comprise the following devices:

a conventional aerodynamic pilot controlling lateral acceleration including for example, an accelerometer, a gyrometer, and an integrating device, a force pilot with a short response time and its control device, a simulator of the force pilot behaviour that can receive information from the force control device, from the gyrometer, from the accelerometer and from a sensor, the arrangement of said devices being such that the guidance command augmented with the output from the simulator is applied to the input of the aerodynamic pilot and a servo-control error of the aerodynamic pilot with respect to said guidance command is applied to the input of both the control devices of the PIF device and the simulator.

* * * * *